United States Patent [19]

Coffman

[11] Patent Number: 4,961,274

[45] Date of Patent: Oct. 9, 1990

[54] SEAL SYSTEM FOR DRYER

[75] Inventor: Randall R. Coffman, Palatine, Ill.

[73] Assignee: Norman Dryer Company, Inc., Crystal Lake, Ill.

[21] Appl. No.: 329,395

[22] Filed: Mar. 27, 1989

[51] Int. Cl.[5] ..... F26B 11/02

[52] U.S. Cl. ..... 34/133; 34/242; 34/139; 118/19; 118/20

[58] Field of Search ..... 34/133, 242; 118/19, 118/20, 139; 277/3, 12, 35, DIG. 7

[56] References Cited

U.S. PATENT DOCUMENTS 2,517,470 8/1950 Erisman ..... 34/242 X
4,245,580 1/1981 Okawara ..... 118/20 X
4,407,078 10/1983 Takeyama et al. ..... 34/133
4,785,759 11/1988 Motoyama et al. ..... 34/133 X

*Primary Examiner*—Albert J. Makay
*Assistant Examiner*—John Sollecito
*Attorney, Agent, or Firm*—Lee, Mann, Smith, McWilliams & Sweeney

[57] ABSTRACT

A seal system for preventing leakage of air from the tumbler cylinder of a dryer. The system includes a pair of spaced seal members derfining a zone through which air is withdrawn from the cylinder. End seals are provided at each end of the cylinder, each end seal comprising a laterally shiftable annular ring abutting the respective end.

16 Claims, 4 Drawing Sheets

10
14
24
20
26
90
88
86
18
16
18
14
12
20
102
22
104

Fig. 4.
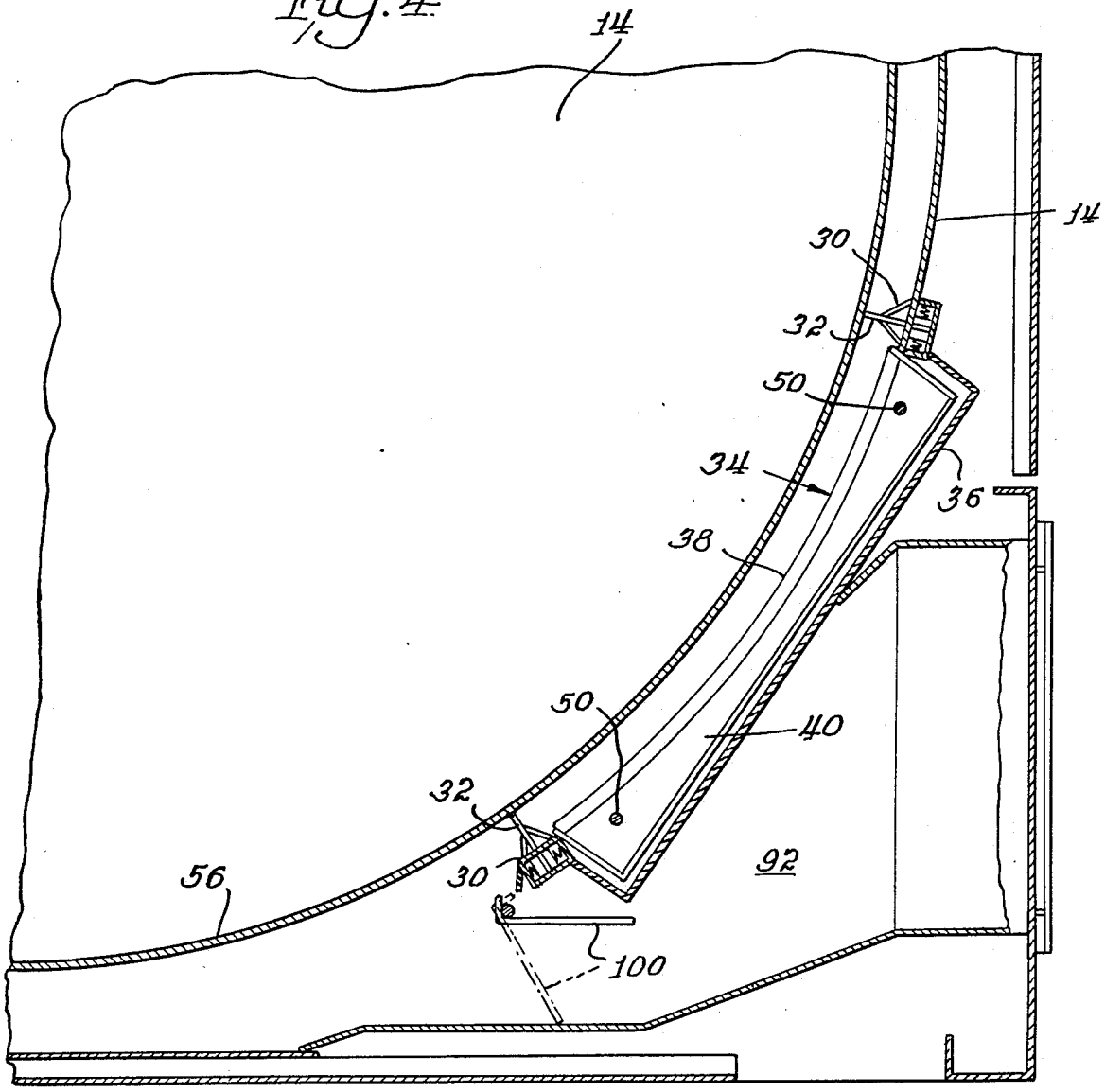
Fig. 5.
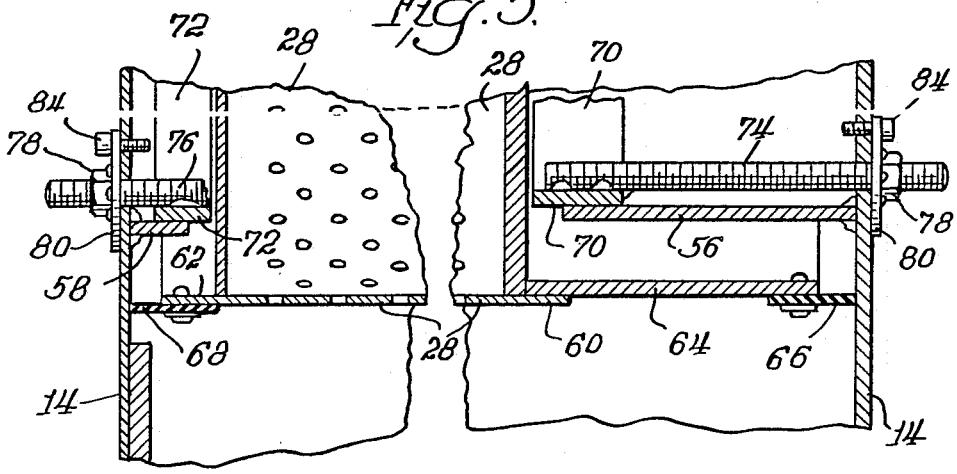
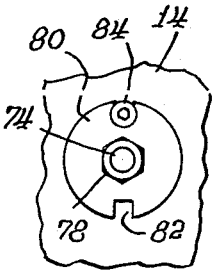
Fig. 6.

SEAL SYSTEM FOR DRYER

BACKGROUND OF THE INVENTION

This invention relates to dryers for extracting moisture from wet goods, such as linens, and in particular to a dryer having a seal system for preventing leakage of air from the tumbler cylinder of the dryer.

Dryers of the nature of the present invention are typically utilized in commercial laundering facilities where large quantities of wet linens are dried in batches of up to several hundred pounds. Wet linens are delivered to the dryer in large "cakes" such as those illustrated in U.S. Pat. No. 4,509,275, the disclosure of which is incorporated herein by reference.

A typical commercial dryer includes a tumbler cylinder mounted for rotation about a horizontal axis and which has an open side through which cakes of linens are inserted and dried goods are removed. The cylinder is housed within a shell and is rotated about the horizontal axis. The shell is pivoted at either its bottom or its top so that the shell can be tipped forward or rearward to permit dry linens to be removed therefrom.

As energy costs have escalated, it has become particularly important that the efficiency of the dryer be as high as possible. One major area of loss in the typical dryer is due to leakage of heated air, usually in the vicinity of the tumbler cylinder. While rubber gaskets and similar seals have been used in the past in order to form appropriate seals to prevent air leakage or prevent migration of heated drying air directly to the air outlet without passing through the wet goods in the interior of the tumbler cylinder, because of the nature of items dried in a commercial dryer, such seals are often ineffective. Not only do the seals dry and crack with age, but also any foreign objects which might find their way into the tumbler cylinder tend to protrude through the perforated openings in the cylinder, and tear the seals as the tumbler cylinder is rotated. Thus, flexible rubber seals are usually rendered partly or wholly inoperative soon after a commercial dryer is placed into operation.

SUMMARY OF THE INVENTION

The dryer of the invention is of the type for extracting moisture from wet goods, and includes a tumbler cylinder mounted for rotation about a horizontal axis and having a particular cylinder length. The tumbler cylinder has a curved cylindrical outer surface and generally planar ends, and a shell is provided in which the tumbler cylinder is housed and which generally surrounds the cylinder. Means is provided for supplying heated air to the cylinder for drying goods therein and for withdrawing air from the cylinder. The invention relates to a seal system for preventing leakage of air from the cylinder. The seal system comprises a laterally movable seal means located in the shell and defining a zone through which air is withdrawn from the cylinder. The seal means comprises at least one seal member having a length at least as great as the length of the cylinder and having a seal surface conforming to the curved outer surface of the cylinder. Appropriate means is provided for mounting the seal means in the shell. The seal system also includes an end seal for each end of the cylinder, each end seal comprising an annular ring abutting each end of the tumbler cylinder, and including means for laterally shifting each ring toward and away from each planar end in order to effect the best possible seal between the ring and the end of the tumbler cylinder.

In accordance with the preferred embodiment of the invention, each seal member comprises a module mounted in the shell. The curved surface of each seal member has a width extending for an arc of greater than 10° of the surface of the tumbler cylinder. Preferably, the arc is approximately 35°.

The means for mounting each module in the shell comprises a pair of rods secured to each end of each module. The rods extend through slotted apertures in opposite ends of the shell, and a nut is threadedly engaged on each rod for securing the module in place. By loosening of the nuts, the rods can be shifted in the slots, permitting close adjustment of each module to the conforming cylindrical outer surface of the tumbler cylinder.

For laterally shifting each of the annular end ring seals, a plurality of threaded rods is secured to each of the rings, each rod of each ring extending through an aperture in the shell and including a nut engaged on the rod. The nut may be locked in place at an axial location on the rod to secure the ring in an orientation proximate the end of the tumbler cylinder. In accordance with the preferred embodiment of the invention, each nut includes a collar secured thereto, the collar having a series of peripheral notches, with a screw being threadedly secured in the shell and engaging one of the notches. In order to hold the rings securely in place, each ring is mounted within a guide ring permanently attached to a respective end of the shell.

BRIEF DESCRIPTION OF THE DRAWINGS

The invention is described in greater detail in the following description of an example embodying the best mode of the invention, taken in conjunction with the drawing figures, in which:

FIG. 4 is an enlarged partial elevational view of the lower right-hand corner of the shell, showing one of the seal modules, FIG. 5 is an enlarged partial cross-sectional view, with portions broken away, taken through the tumbler cylinder and shell, and showing portions of the end ring seals, FIG. 6 is a plan view of one of the locking nuts for the adjustment rods of each of the end ring seals.

DESCRIPTION OF AN EXAMPLE EMBODYING THE BEST MODE OF THE INVENTION

Figure 1:
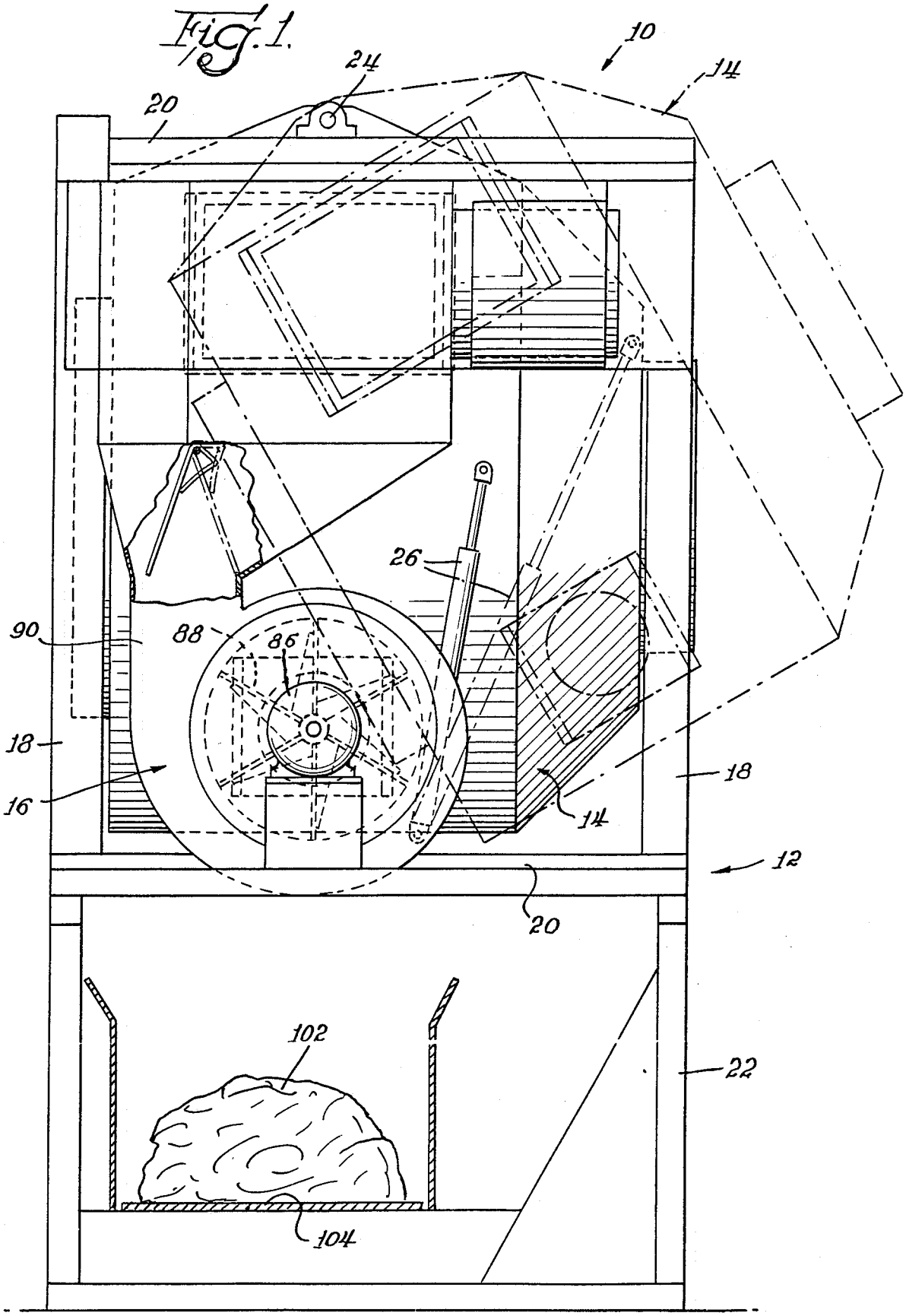
FIG. 1 is a side elevational view of a dryer according to the invention, with the shell being shown in a pivoted fashion in phantom for expulsion of dried linens therefrom.

A dryer according to the invention is shown generally at 10 in the drawing figures. Primary components of the dryer 10 are an external support or frame 12, a pivotal tumbler shell 14, and an air delivery and recirculating system 16.

The frame 12 comprises a box-like framework composed of a series of vertical posts 18 interconnected by a series of horizontal cross members 20 at the top and bottom of the frame 12. The entire frame 12 sits upon a base 22 also composed of a series of vertical and horizontal framework members. The frame 12 and base 22 may be essentially the same as those of referenced U.S. Pat. No. 4,509,275.

The tumbler shell 14 is mounted in the frame 12 by means of a pivot 24, and is pivoted by means of a pair of pneumatic cylinders 26 secured between the frame 12 and the shell 14. Extension of the rams of the cylinders 26 pivots the shell about the pivot 24, as shown in phantom in FIG. 1. The cylinders 26 and their means of attachment and operation are conventional.

A tumbler cylinder 28 is housed within the shell 14. For the ease of explanation, the cylinder 28 has been omitted from FIGS. 2 and 4, and the details of suspension of the cylinder 28 within the shell 14 have also not been illustrated. Both the cylinder 28 and shell 14 may be conventional to the extent not described herein. Common mounting for the cylinder 28 includes a trunnion at the rear thereof which extends into a motor housing at the rear of the shell 14.

A conventional seal for sealing between the shell 14 and the tumbler cylinder 28 is a wiper seal 30, four of which are employed in the dryer 10. Each of the wiper seals 30 includes a flexible wiper 32 which contacts the cylinder 28 as it rotates. The wiper seals 30 extend the length of the cylinder 28, between opposite ends of the shell 14.

Figure 7:
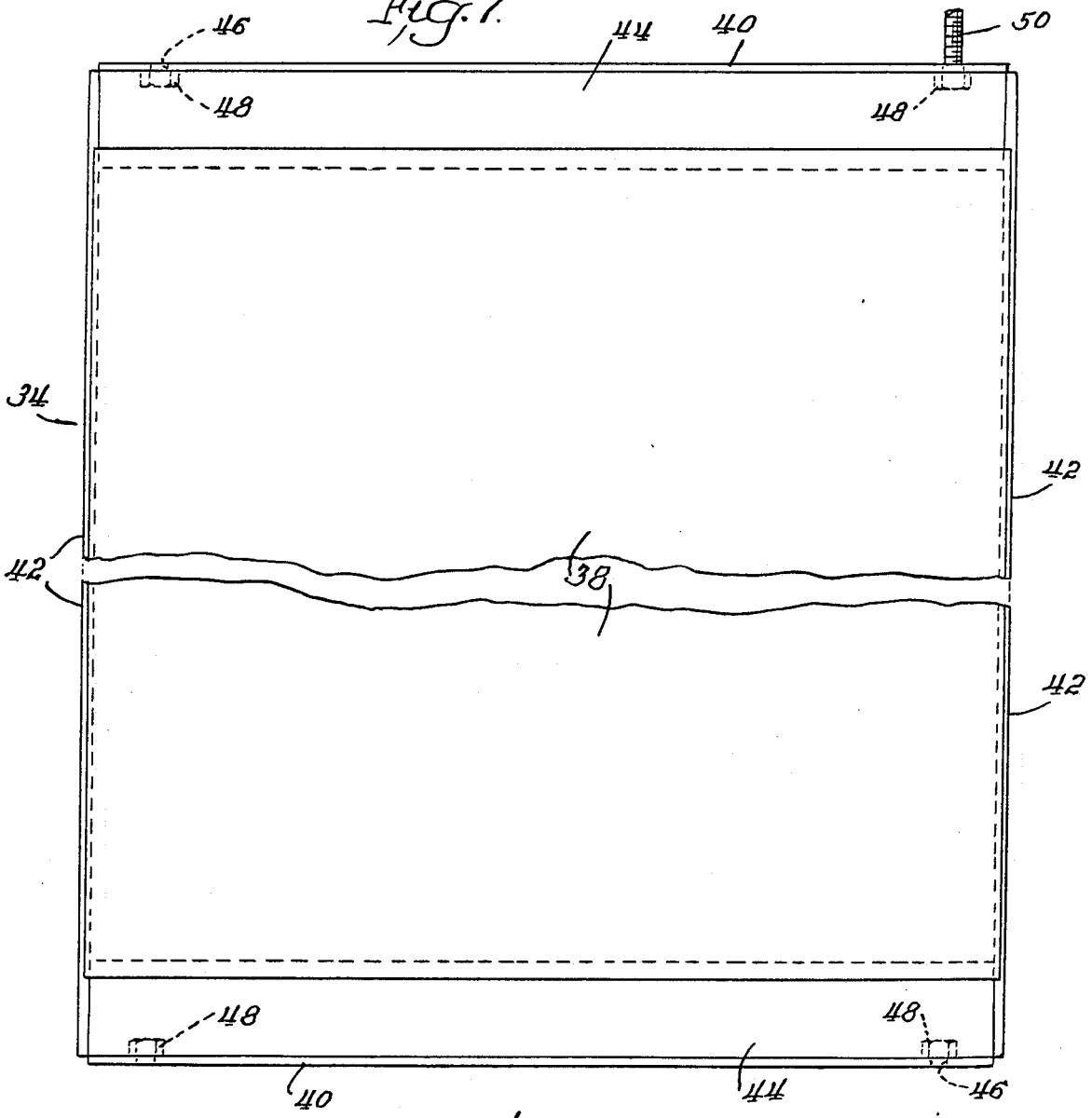
FIG. 7 is a plan view, with the central portion broken away, of one of the seal modules.
Figure 8:
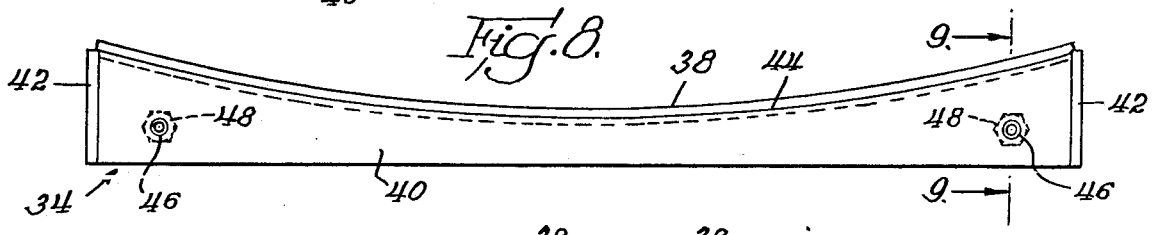
FIG. 8 is an end view thereof and FIG. 9 is an enlarged cross-sectional view, with the central portion broken away, taken along lines 9—9 of FIG. 8.
Figure 9:
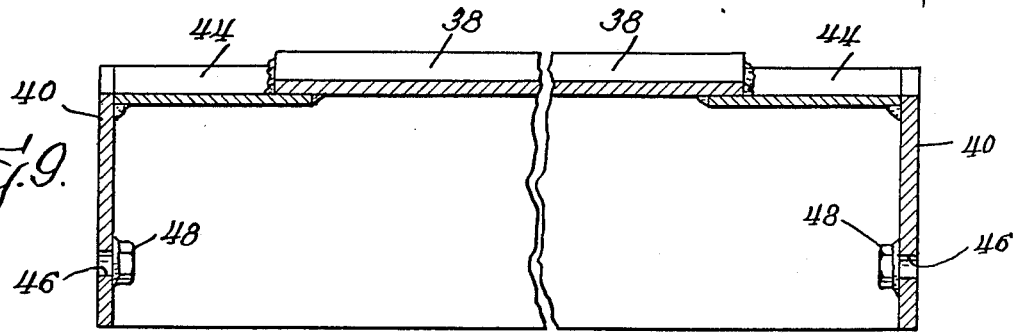

The dryer 10 includes a pair of laterally movable seal members in the form of a module 34 located within a module housing 36 formed in the tumbler shell 14. The modules 34 are identical, and are best illustrated in FIGS. 4 and 7–9. Each of the modules 34 has a length at least as great as the length of the cylinder 28, and has a curved seal surface 38 which conforms to the curved outer surface of the cylinder 28. End plates 40 are provided at opposite ends of each module 34, and rectangular side supports 42 are provided at each side. As best shown in FIGS. 7 and 9, the seal surface 38 may terminate before reaching each of the end plates 40, there being provided a lower elevation curved surface 44 which may accommodate any protruding nuts, rivets or the like on opposite sides of the cylinder 28. Should the cylinder 28 have no protruding elements, the seal surface 38 can extend from end plate 40 to opposite end plate 40.

Figure 3:
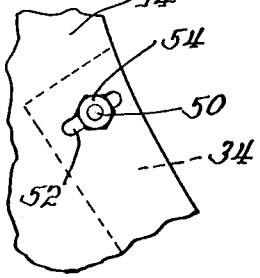
FIG. 3 is an enlarged plan view of the means of attachment of each of the seal modules to the shell for the tumbler cylinder.

Each of the end plates 40 includes an aperture 46 and a nut 48 secured, as by welding, at each of the apertures 46. A threaded rod 50 (only one shown in FIG. 7, and being omitted from FIGS. 8 and 9) is threaded into each of the nuts 48 through the apertures 46, protruding from the opposite end plates 40 of the module 34. The rods 50 extend through slotted apertures 52 in the tumbler shell 14, and are engaged by nuts 54 (FIG. 3). When the nuts 54 are tightened on the rods 50, the modules 34 are held in place within the module housings 36.

Figure 2:
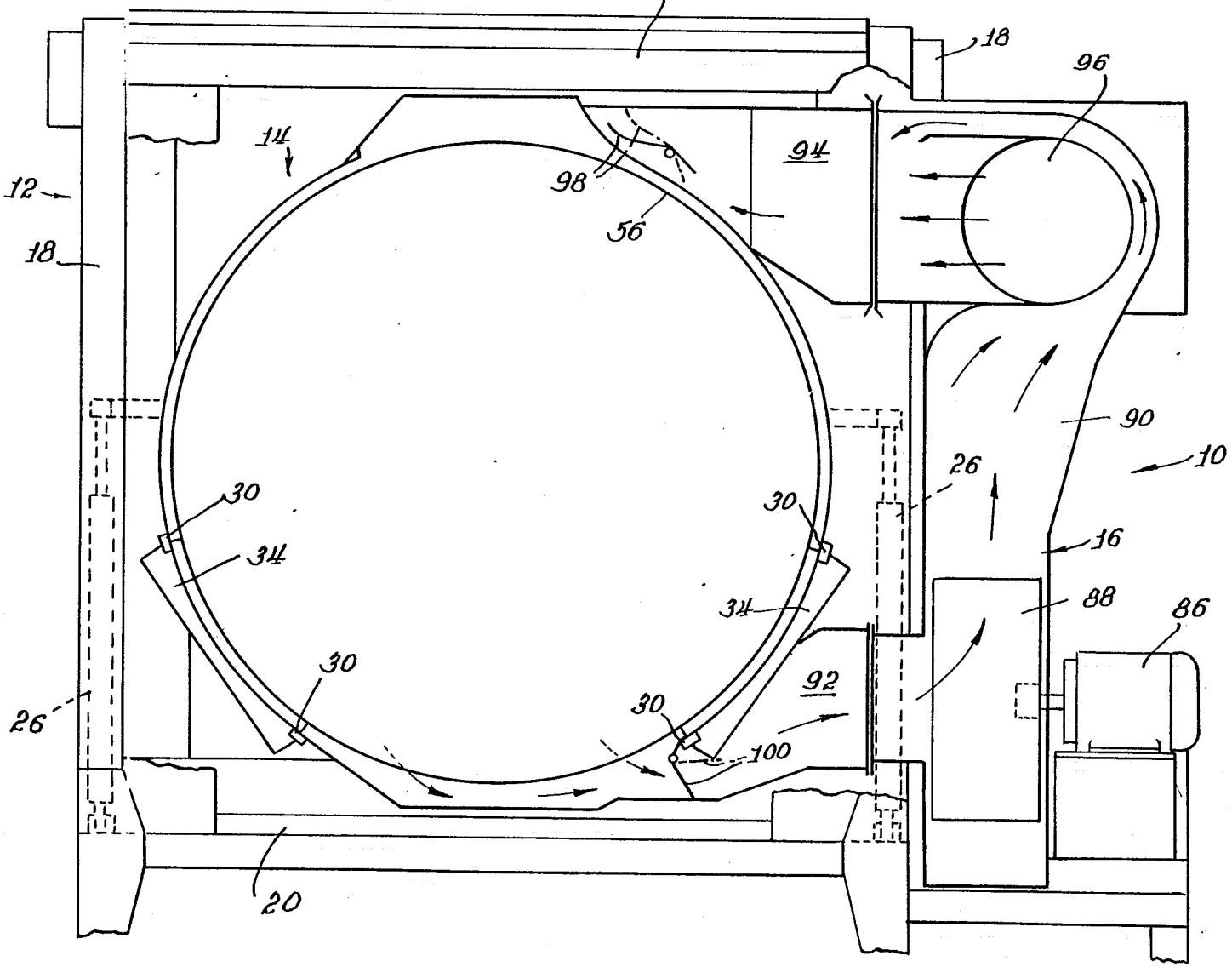
FIG. 2 is a front elevational view thereof, with portions broken away and removed, and with the tumbler cylinder omitted for purposes of explanation.

A guide ring 56 is secured to the rear of the tumbler shell 14, as shown in FIGS. 2 and 4, and a similar guide ring 58 is secured to the front portion of the tumbler shell 14. The guide ring 58 is illustrated only in cross section in FIG. 5. The rings 56 and 58 are steel, and are welded or otherwise appropriately permanently attached to the tumbler shell 14. While each of the rings 56 and 58 is preferably a continuous annular member, the rings 56 and 58 may be formed in sections, as well.

As shown in FIG. 5, the tumbler cylinder 28 is perforated, and includes flange portions 60 and 62 extending beyond the planar ends thereof. A ring extension 64 is attached to the flange portion 60, extending to a short distance from the rear wall of the tumbler shell 14. To create a seal between the tumbler cylinder 28 and the front and rear walls of the tumbler cylinder 14, a sealing ring 66 is attached to the ring extension 64 and a sealing ring 68 is attached to the flange portion 62. The sealing rings 66 and 68 are of flexible material, such as rubber, and are secured by means of screws or other fasteners, as appropriate.

As explained above, the flexible rubber sealing rings 66 and 68 commonly become damaged or worn, and therefore air leakage between the tumbler cylinder 28 and the shell 14 is common. In order to substantially eliminate such leakage, the invention also includes an annular ring 70 contained within the guide ring 56 in close proximity to the rear planar end of the tumbler cylinder 28. A second annular ring 72 is contained within the guide ring 58 in close proximity to the planar front end of the tumbler cylinder 28. While, for purposes of illustration, the rings 70 and 72 are shown with a substantial gap between them and the tumbler cylinder 28, in actual practice, only a very slight gap, just enough to prevent rubbing of the tumbler cylinder 28 on the rings 70 and 72, is sufficient.

A series of threaded rods 74 are secured to the ring 70, and extend through appropriate apertures in the shell 14. Similarly, a series of threaded rods 76 are secured to the ring 72, also extending through appropriate apertures in the shell 14. Each of the rods 74 and 76 is capped by a nut 78 having an integral collar 80. The collars 80 include a series of peripheral notches 82, as illustrated in FIG. 6. A cap screw 84, threadedly engaged in the shell 14, passes through one of the notches 82 in the collar 80 to secure the nut 78, and therefore the rod 74, in place.

The air delivery and recirculating system 16 comprises a blower motor 86 and blower 88 situated within a duct 90. The duct 90 in turn is in communication with an exit duct 92 communicating with an exit zone between the two modules 34 and an entry duct 94 in communication with top of the tumbler shell 14. A conventional burner 96 is provided for heating the drying air. Because the tumbler shell 14 is pivotal relative to the duct 90, appropriate flanges are formed on the ducts 90 and 92, and 90 and 94, where they abut. The air delivery and recirculating system forms no part of the invention, and may be conventional, and is therefore not described further.

The tumbler cylinder 28, when mounted within the tumbler shell 14, is rotatable only about its central horizontal axis. Otherwise, the tumbler cylinder 28 is fixed relative to the shell 14 so that relative lateral movement therebetween is impossible. When the cylinder 28 is installed, as explained above the conventional wiper seals 30 contact the rotatable cylinder 28, while the flexible sealing rings 66 and 68 contact the shell 14, forming a preliminary seal. As explained above, the rings 66 and 68 and wiper seals 30 were, before the present invention, the only seals provided.

At the time that the tumbler cylinder 28 is installed, the modules 34 are also adjusted by means of the rods 50 and nuts 54. The modules 34 are adjusted just short of contact with the tumbler cylinder 28, being as close as physically possible without actually rubbing upon the tumbler cylinder 28 as it rotates. As the same time, the rings 70 and 72 are adjusted by means of their respective threaded rods 74 and 76 to as close physical proximity to the planar end walls of the tumber cylinder 28 as possible, again without rubbing on the tumbler cylinder 28 as it rotates. The rings 70 and 72 form a primary seal at the ends of the tumbler cylinder 28, while the conventional sealing rings 66 and 68 form a secondary seal.

Airflow into the tumbler cylinder 28 from the air delivery and recirculating system 16 is controlled by means of a damper 98. Air recirculated into the system 16 is controlled by means of a damper 100. When air enters the shell 14 via the entry duct 94, air is prevented from escaping to the atmosphere by means of the rings 70 and 72, and secondary sealing rings 66 and 68. At the same time, air is prevented from escaping about the outer periphery of the tumbler cylinder 28 by means of the modules 34 and secondary wiper seals 30. Thus, air entering via the entry duct 94 is introduced to the interior of the tumbler cylinder 28 through the series of perforations therein, where the heated air comingles with the wet goods within the cylinder 28. Air may escape the tumbler cylinder 28 only in the zone extending between the two modules 34, where a portion of the air is recirculated, and a portion of the now moisture-laden air is expelled to the atmosphere.

The width of the modules 34 is particularly important to the efficacy and efficiency of the seal system of the invention. Because the modules 34 cannot directly contact the rotating tumbler cylinder 28, there is a slight gap therebetween. However, the wider the modules 34, the greater the resistance to any airflow from one side of a module 34 to the other. The modules 34 illustrated in the drawing occupy an arc of approximately 35° of the 360° circumference of the tumbler cylinder 28. That illustrated is preferred, although modules of lesser width can be employed, obviously with greater chances of air leakage as the width diminshes. A minimum width of no less than an arc of 10° is that preferred as the smallest dimension.

The dryer 10 operates in a conventional fashion, substantially similar to that of referenced U.S. Pat. No. 4,509,275. After a load of goods has been dried within the dryer 10, the tumbler shell 14 is pivoted rearwardly to the orientation shown in phantom in FIG. 1. The tumbler cylinder 28 is then rotated in order to expell the dried goods, which, as indicated at 102, fall onto a conveyor 104, where they are transported for further processing as needed.

Various changes may be made to the invention without departing from the spirit thereof or scope of the following claims:

What is claimed is:

1. In a dryer for extracting moisture from wet goods, the dryer including a tumbler cylinder mounted for rotation about a horizontal axis and having a particular cylinder length, the tumbler cylinder having a curved cylindrical outer surface and generally planar ends, a shell in which the tumbler cylinder is housed and which generally surrounds the cylinder, and means for supplying heated air to the cylinder for drying goods therein and withdrawing air from the cylinder, the improvement comprising a seal system for preventing leakage of air from the cylinder, the seal system comprising a. laterally movable seal means located in said shell and defining a zone through which air is withdrawn from the cylinder, said seal means comprising at least one seal member having a length at least as great as said cylinder length and having a curved seal surface closely conforming to a portion of the curved outer surface of said cylinder, b. means mounting said seal means in said shell with said curved seal surface being located immediately adjacent said curved outer surface and corresponding to said curved outer surface without touching the curved outer surface as the tumbler cylinder rotates in order to resist airflow from one side of said seal member to another side of said seal member along said curved seal surface, c. an end seal for each end of said cylinder, each end seal comprising an annular ring abutting each said end, and d. means for laterally shifting each said ring toward and away from said planar end.

2. A dryer according to claim 1 in which said seal member comprises a module mounted in said shell, said curved seal surface having a width extending for an arc of greater than about 10°.

3. A dryer according to claim 2 in which said arc is approximately 35°.

4. A dryer according to claim 1 in which said seal member comprises a module, and in which said mounting means comprises a pair of rods secured to each end of said module, said rods extending through slotted apertures in opposite ends of said shell and including a nut threadedly engaged on each rod.

5. A dryer according to claim 1 in which said seal means comprises a spaced pair of said seal members, said seal members defining said zone therebetween.

6. A dryer according to claim 1 including a pair of longitudinal wiper seals located on opposite sides of each said seal member.

7. A dryer according to claim 1 in which said means for laterally shifting comprises a plurality of threaded rods secured to each said ring, each rod extending through an aperture in said shell and including a nut engaged on said rod, and including means for locking said nut at an axial location on said rod to secure said ring.

8. A dryer according to claim 7 in which said means for locking comprises a collar secured to said nut, said collar having a series of peripherial notches, and including a screw threadedly secured in said shell and engaging one of said notches.

9. A dryer according to claim 7 in which each said ring is mounted within a guide ring attached to a respective end of said shell.

10. In a dryer for extracting moisture from wet goods, the dryer including a tumbler cylinder mounted for rotation about a horizontal axis and having a particular cylinder length, the tumbler cylinder having a curved cylindrical outer surface, a shell in which the tumbler cylinder is housed and which generally surrounds the cylinder, and means for supplying heated air to the cylinder for drying goods therein and withdrawing air from the cylinder, the improvement comprising a seal for preventing leakage of air from the cylinder, the seal comprising a. a laterally movable seal means located in said shell and defining a zone through which air is withdrawn from the cylinder, said seal means comprising a pair of spaced seal members having a length at least as great as said cylinder length and having a curved seal surface closely conforming to a portion of the curved outer surface of said cylinder, and b. means mounting said seal means in said shell with said curved seal surface being located immediately adjacent said curved outer surface and corresponding to said curved outer surface without touching the curved outer surface as the tumbler cylinder rotates in order to resist airflow from one side of said seal member to another side of said seal member along said curved seal surface.

11. A dryer according to claim 10 in which said seal members each comprise a module mounted in said shell, said curved surface having a width extending for an arc of greater than about 10°.

12. A dryer according to claim 11 in which said arc is approximately 35°.

13. A dryer according to claim 10 in which each said seal member comprises a module, and in which said mounting means comprises a pair of rods secured to each end of said module, said rods extending through slotted apertures in opposite ends of said shell and including a nut threadedly engaged on each rod.

14. A dryer according to claim 10 including a pair of longitudinal wiper seals located on opposite sides of each said seal member.

15. In a dryer for extracting moisture from wet goods, the dryer including a tumbler cylinder mounted for rotation about a horizontal axis and having generally planar ends, a shell in which the tumbler cylinder is housed and which generally surrounds the cylinder, and means for supplying heated air to the cylinder for drying goods therein and withdrawing air from the cylinder, the improvement comprising a seal for preventing leakage of air from the ends of the cylinder, the seal comprising a. an end seal for each end of said cylinder; each end seal comprising an annular ring abutting each said end, b. means secured to said shell for mounting each ring proximate a respective end of said cylinder, and c. means for laterally shifting each said ring toward and away from said planar end, said means for shifting comprising a plurality of threaded rods secured to each said ring, each rod extending through an aperture in said shell and including a nut engaged on said rod, and including means for locking said nut at an axial location on said rod to secure said ring, said means for locking comprising a collar secured to said nut, said collar having a series of peripherial notches, and including a screw threadedly secured in said shell and engaging one of said notches.

16. A dryer according to claim 15 in which said mounting means comprises a guide ring attached to a respective end of said shell.

* * * * *